United States Patent [19]

Takahashi

[11] 4,176,834

[45] Dec. 4, 1979

[54] SHEET TRANSFER DEVICE

[75] Inventor: Yuji Takahashi, Tokyo, Japan

[73] Assignee: Canon Kabushiki Kaisha, Tokyo, Japan

[21] Appl. No.: 837,373

[22] Filed: Sep. 28, 1977

[30] Foreign Application Priority Data

Oct. 1, 1976 [JP] Japan ..... 51-118336

[51] Int. Cl.[2] ..... B65H 3/06

[52] U.S. Cl. ..... 271/116; 271/117; 271/264

[58] Field of Search ..... 271/117, 118, 116, 114, 271/109, 126, 127, 37, 38, 264, 272, 273, 274, 80

[56] References Cited

U.S. PATENT DOCUMENTS 985,428 2/1911 McArdle et al. ..... 271/117

3,556,516 1/1971 Jones et al. ..... 271/116

*Primary Examiner*—Bruce H. Stoner, Jr.

*Attorney, Agent, or Firm*—Fitzpatrick, Cella, Harper & Scinto

[57] ABSTRACT

A sheet transfer device includes a first arm rotatably mounted on a drive shaft, a second arm rotatably mounted on the drive shaft at a different position, a first sheet transfer device mounted on the first arm, a second sheet transfer device mounted on the second arm and rotatable independently of the first transfer device, a first transmitter for transmitting the rotation of the shaft to the first sheet transfer device, and a second transmitter for transmitting the rotation of the drive shaft to the second sheet transfer device, the sheet transfer devices being biased toward a predetermined direction.

12 Claims, 8 Drawing Figures

SHEET TRANSFER DEVICE

BACKGROUND OF THE INVENTION

1. Field of the Invention

The present invention relates to a sheet transfer device, and more particularly to a sheet transfer device capable of preventing diagonal advancement of sheet.

2. Description of the Prior Art

Printing apparatus, particularly sheet-fed printing apparatus, requires a secure transfer operation, one by one, of sheet materials previously cut to a predetermined size. This requirement is particularly emphasized in case said printing apparatus is for example a computor terminal consuming a large quantity of sheet materials.

The commonly encountered troubles in the sheet transfer are represented by diagonal sheet transfer wherein the sheet is advanced in a diagonal direction and superposed transfer wherein plural sheets are advanced simultaneously, and the prevention of the former is essential for improving the reliability of the apparatus as it frequently gives rise to sheet jamming in the recording mechansim.

The one-by-one transfer, from the upper part of sheets stacked in a storage device, is usually achieved by a pair of transfer rollers which should freely follow the unevenness or inclination of the sheet surface thereby constantly applying the same pressure for both rollers and thus preventing the formation of undesirable fractional force not directed in the proper direction of transfer, which would otherwise give rise to a diagonal transfer of the sheet.

In ordinary electronic copying machines, the sheet materials, for example recording sheets, are accommodated in a relatively limited quantity in a cassette which is structured to support the stacked sheets by means of a spring, etc., and to uniformly press said sheets against the transfer rollers.

In such conventional apparatus, the uniform mutual contact between the recording sheet and the transfer rollers has thus been realized by uniformly elevating the stacked sheets rather than by providing the transfer rollers with a non-uniform pressurizing mechanism.

However, in a recording apparatus consuming a large quantity of sheet materials within a limited time (for example a recording apparatus disclosed in the U.S. patent application Ser. No. 616,675, now U.S. Pat. No. 4,059,833, of the present applicant wherein the information is recorded on a photosensitive drum by means of a laser beam modulated by the output of a computer and then transferred onto a recording sheet), it is preferable to accommodate an elevated quantity of recording sheets, for example 3,000 sheets, in the storage device in order to extend the interval between the sheet replenishments. In such case with such bulk quantity of stack, it is desirable that the transfer rollers are capable of following the stacked sheets, thus providing non-uniform pressure thereto.

For the purpose of one-by-one transfer of sheet materials from such storage device, there is already known a sheet transfer device as illustrated in FIG. 1, wherein the sheets 10 stacked in a sheet storage device (not shown) are advanced in the direction of arrow F by means of rollers to be explained later.

There is provided a drive shaft 11 arranged approximately parallel to the front edge of said sheet 10 and driven by a paper feed motor (not shown). On said drive shaft provided rotatably are arms 12-1, 12-2 which support rotatably and with a certain play a roller shaft 13 which in turn supports rollers 14-1, 14-2 so as to be rotatable only in one direction and also supports a gear 15 firmly mounted on said roller shaft and linked through a chain 17 with a gear 16 mounted on said drive shaft 11 thereby rotating said rollers 14-1, 14-2 by driving said drive shaft 11.

There is also provided a shaft 18 for connecting and fixing said arms 12-1, 12-2 and for supporting weights 19 for adjusting the pressure of said rollers applied on the stacked sheets 10.

In such sheet transfer device, the arm 12-1 can be twisted with respect to the arm 12-2 due to the presence of a certain play in the mounting between the arms 12 and the shaft 18 or roller shaft 13, and, as shown in FIG. 2, the roller shaft 13 is capable of assuming a position inclined by an angle $\theta$ when the sheet 10 becomes inclined with respect to the drive shaft 11, thus enabling intimate contact of the rollers 14-1, 14-2 with the sheet 10.

In such device, however, it was experimentally confirmed that, even if the rollers 14 in the stationary state thereof apply the same pressures to the sheet 10, the transmission of a rotary drive force to the drive gear 15 causes the roller 14-1 located closer to said gear 15 to sink and the other roller 14-2 to rise, thereby rendering the drive force of the roller 14-1 larger than that of roller 14-2 and thus creating a tendency of diagonal advancement of the sheet 10.

SUMMARY OF THE INVENTION

The present invention proposes to eliminate such drawbacks in the conventional device, and the object thereof is to provide a sheet transfer device capable of eliminating the possibility of diagonal advancement in the sheet transfer.

Another object of the present invention is to provide a sheet transfer device of a simple structure allowing a low manufacturing cost.

Still another object of the present invention is to provide a sheet transfer device adapted for sheet transfer from a storage device accommodating a large quantity of stacked sheets.

Still another object of the present invention is to provide a sheet transfer device capable of pressing the transfer rollers uniformly against the sheet.

Other objects and advantages of the present invention will be made apparent from the following description with particular reference to the attached drawings, wherein:

BRIEF DESCRIPTION OF THE DRAWING

FIGS. 3 to 5 are drawings of a first embodiment of the sheet transfer device of the present invention wherein FIG. 3 is a perspective view thereof, FIG. 5 is an elevation view showing a state wherein the sheets are stacked on an incline;

FIGS. 6 and 7 illustrate a second embodiment of the sheet transfer device of the present invention wherein FIG. 6 is a perspective view thereof, and FIG. 7 is an elevation view showing a state where the sheets are stacked on an incline.

DESCRIPTION OF THE PREFERRED EMBODIMENT

Figure 3:
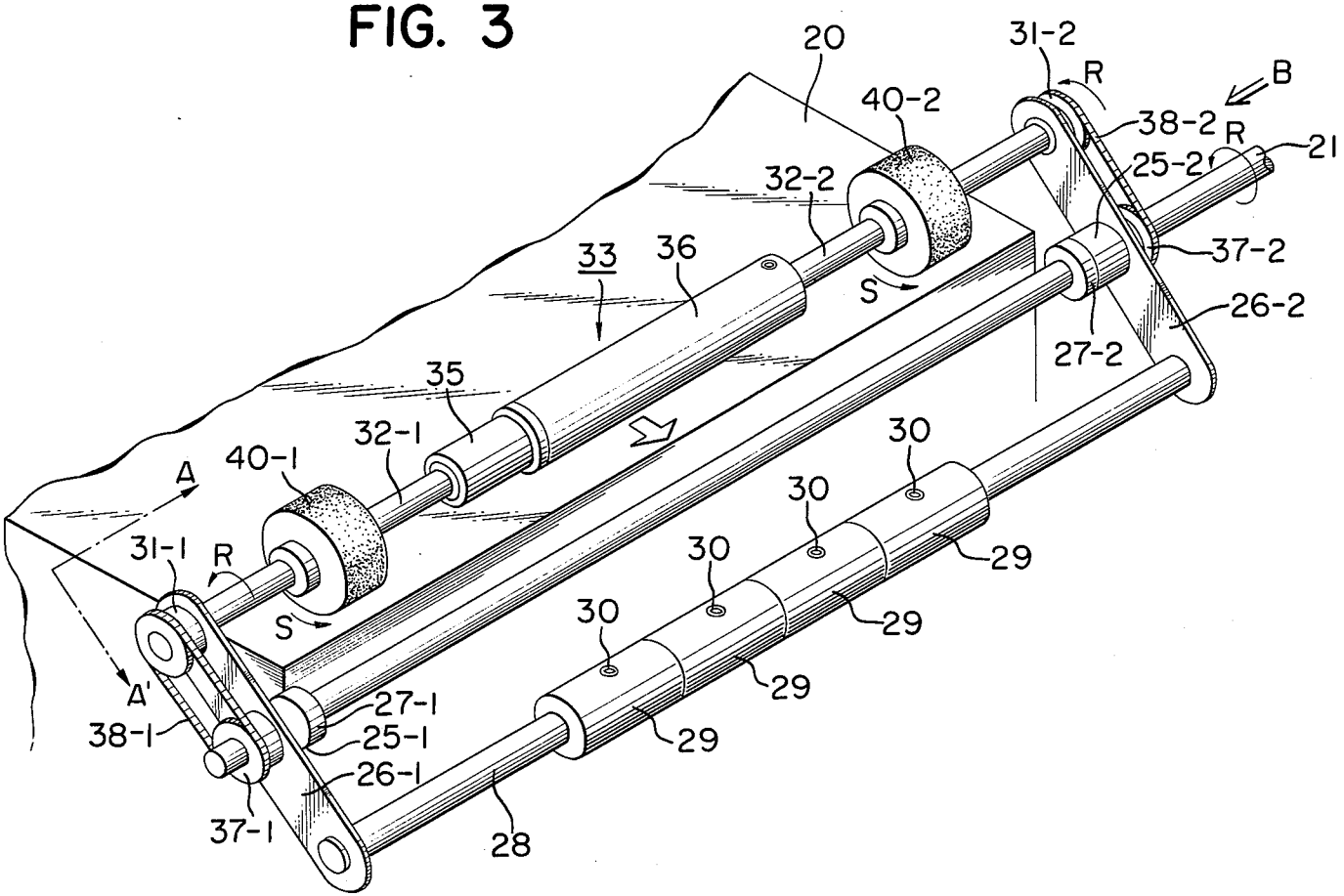
Figure 4B:
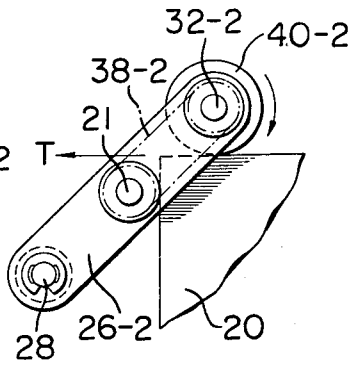
FIG. 4B is a lateral view taken from the direction of arrow B in FIG. 3.
Figure 4A:
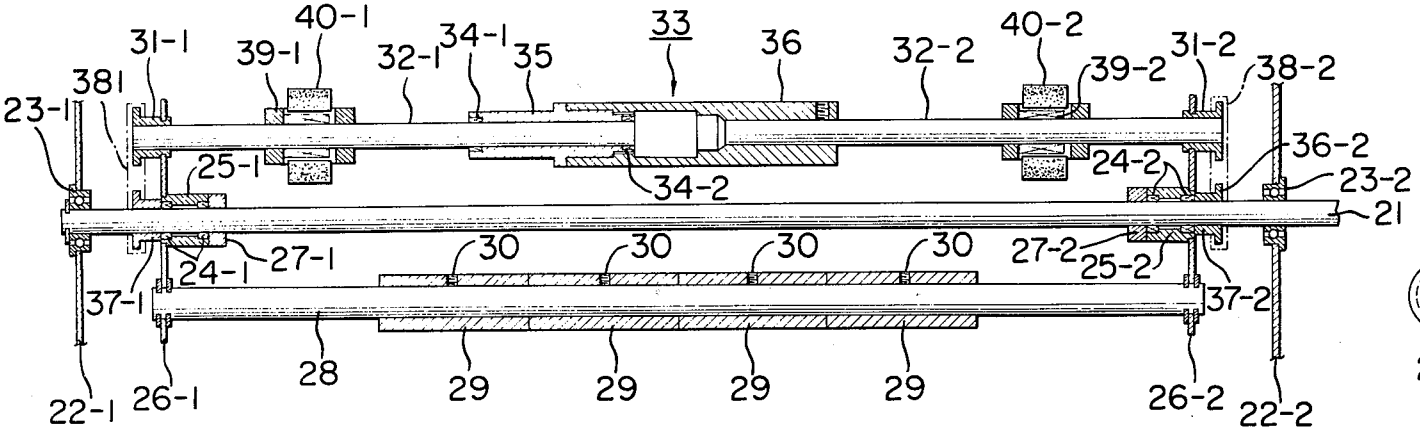
FIG. 4A is a cross-sectional view along the line A—A' in FIG. 3.
Figure 5:
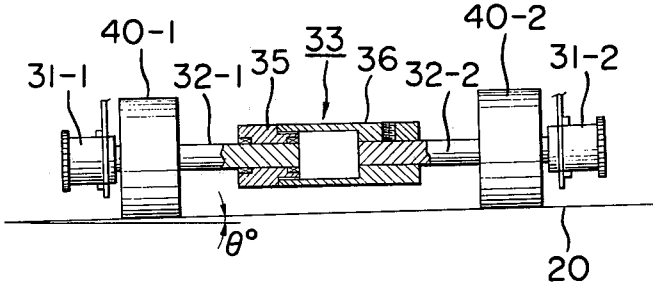

Now referring to FIGS. 3–5 illustrating a first embodiment of the present invention, there is provided a drive shaft 21 driven for example by a sheet feed motor (not shown) and arranged approximately parallel to the front edge of sheets 20 stacked in a storage device (not shown).

The drive shaft 21 is rotatably mounted, by means of bearings 23-1, 23-2, on frames 22-1, 22-2 constituting a part of the recording apparatus (not shown). Said drive shaft 21 supports, through bearings 24-1, 24-2, the housings 25-1, 25-2 on which arms 26-1, 26-2 are firmly attached. The axial displacement of said arms on the drive shaft 21 is limited as the position of said housings 25-1, 25-2 is defined by thrust rings 27-1, 27-2.

Near one end of each of said arms 26-1, 26-2 there is mounted with a certain play a shaft 28 on which weights 29 are fixed with screws 30, said weights being designed for adjusting the pressure of rollers 40 as will be explained later. On the other extremities of said arms 26-1, 26-2, opposite to those supporting said shaft 28, there are respectively mounted rotatable sprockets 31-1, 31-2 with a certain play with respect to said arms 26, said sprockets being respectively provided with axial throughholes and supporting therein roller shafts 32-1, 32-2 firmly fixed thereto. It will naturally be understood that said sprockets, instead of being rotatably mounted directly on said arms, can also fixed on said roller shafts which in turn are rotatably mounted on said arms 26.

The roller shafts 32-1, 32-2 are mutually connected, at the mutually facing extremities thereof, by a coupling means 33 which maintains said shafts in a mutually rotatable and aligned relationship.

More specifically the roller shaft 32-1 is provided with bearings 34-1, 34-2 which externally support a tubular male coupler 35 of an internal diameter somewhat larger than the external diameter of said roller shaft 32-1, while said roller shaft 32-2 is provided at the extremity thereof with a female coupler 36 having a tubular opening of an internal diameter substantially equal to the external diameter of said male coupler 35. Thus said male coupler 35 and female coupler 36 can be firmly fitted together to maintain the roller shafts 32-1, 32-2 in alignment, which however are kept mutually rotatable due to the presence of bearings 34-1, 34-2. The drive shaft 21 is further provided with sprockets 37-1, 37-2 which are respectively linked with the aforementioned sprockets 31-1, 31-2 through chains 38-1, 38-2 functioning as transmitting means for transmitting the rotary drive force of the drive shaft 21 to said roller shafts 32-1, 32-2. These roller shafts 32-1, 32-2 support thereon, through already known one-directional clutches 39-1, 39-2, sheet transfer rollers 40-1, 40-2 made for example of rubber, said one-directional clutches being so structured as to transmit the rotary force to rotate said rollers in the direction of arrow S only when the roller shafts 32-1, 32-2 are driven in the direction of arrow R. The sprockets 37-1, 37-2 are structured mutually the same while said sprockets 31-1, 31-2 are also structured mutually the same, and said rollers 40-1, 40-2 are of the same diameter so that said rollers are theoretically provided with the same sheet transfer speed.

Now referring to FIG. 4B which is a lateral view taken from the direction of arrow B in FIG. 3, it will be clearly observed that a sheet forwarded from the stack of sheets is advanced along the arrow T through a space between the drive shaft 21 and the roller shafts 32 and transferred to a sheet path not represented in the drawing.

The presence of the aforementioned play between the arm 26-1 or 26-2 and shaft 28, between the sprocket 31-1 and arm 26-1, and between the sprocket 31-2 and arm 26-2 renders said arms 26-1, 26-2 individually rotatable around the drive shaft 21 within an angle of apporximately 15° with respect to each other. Sated differently the first arm 26-1 is capable of freely rotating until it forms an angle of approximately 15° with respect to the second arm 26-2, and vice versa.

Also the aforementioned weights 29 and the shaft 28 constitutes a biasing means and are selected in such a manner that the rollers 40 rotatable around the drive shaft 21 provide a predetermined downward pressure in the state shown in FIG. 3.

In the foregoing embodiment, therefore, even when the upper surface of the stacked sheets is inclined by an angle $\theta$ with respect to the drive shaft 21, the rollers 40-1, 40-2 mounted on the roller shafts 32-1, 32-2 mutually connected by the coupler 33 can still be maintained in close contact with said upper surface and can thus perform satisfactory transfer of the sheet 20. Furthermore, the use of separate chain drives for the roller shafts 32-1, 32-2 effectively eliminates the sinking of one roller and the rising of the other roller as explained in connection with FIG. 1, and thus contributes to reduce the diagonal transfer of the top sheet.

Figure 6:
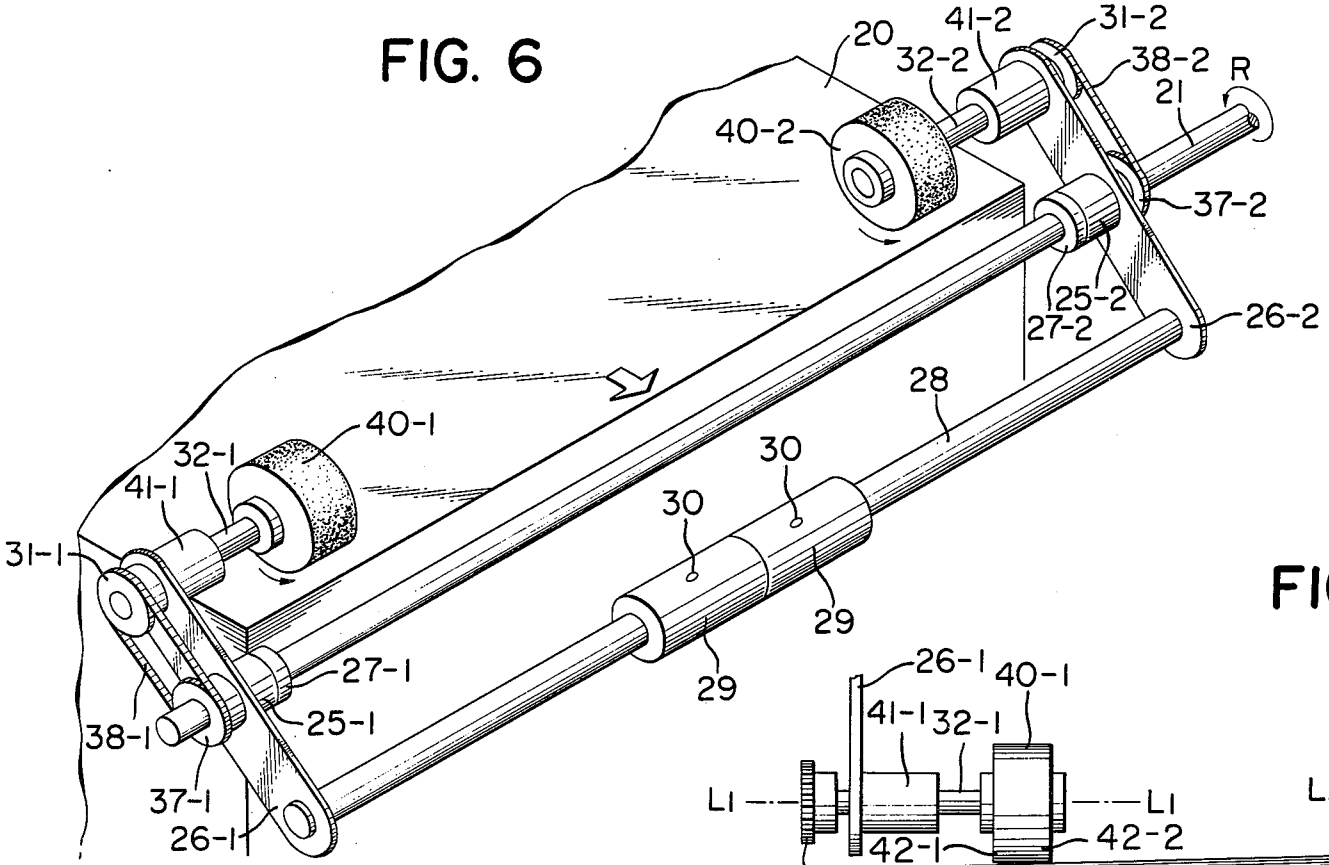
Figure 7:
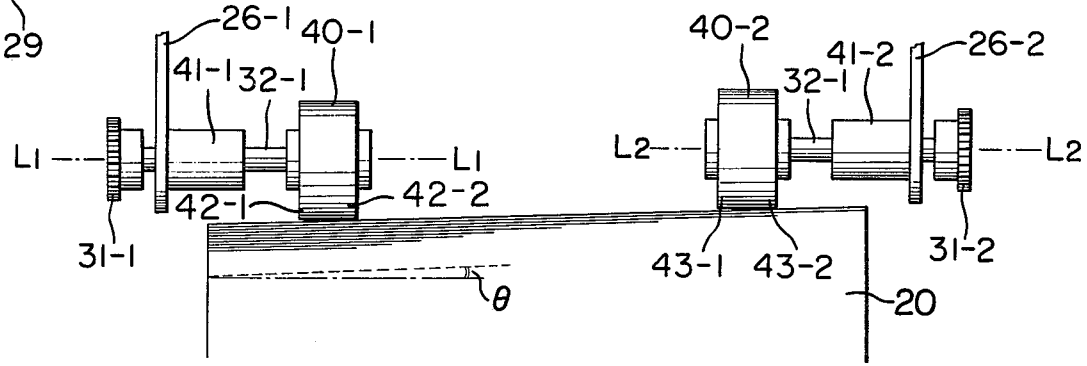

The second embodiment of the present invention illustrated in FIGS. 6 and 7 is different from the first embodiment shown in FIGS. 3 to 5 in that the coupler 33 is no longer present and in that there are provided cylindrical bearings 41-1, 41-2 for rotatably holding the roller shafts 32-1, 32-2 and thereby fixing the angle or relative position thereof with respect to the arms 26-1, 26-2.

Thus the second embodiment is featured in that the cylindrical bearings 41-1, 41-2 firmly mounted, for example by soldering, on the arms 26-1, 26-2 rotatably hold the roller shafts 32-1, 32-2 which in turn hold the sprockets 42-1, 42-2 respectively affixed thereto.

In FIG. 6, the same numerals as in FIG. 3 represent the same components, and the portion not represented in the drawing is structured as in FIG. 4.

Also in this second embodiment, the arms 26 are mounted on the shaft 28 with a certain play therebetween so that the arms 26-1 and 26-2 can be twisted with respect to each other around the drive shaft 21 up to approximately 15°. Thus, when the upper surface of the stacked sheets is inclined by an angle $\theta$ with respect to the drive shaft 21, said arms 26-1, 26-2 assume a mutually twisted position to respectively lower the rollers 40-1, 40-2 until they come in contact with said upper surface.

Figure 1:
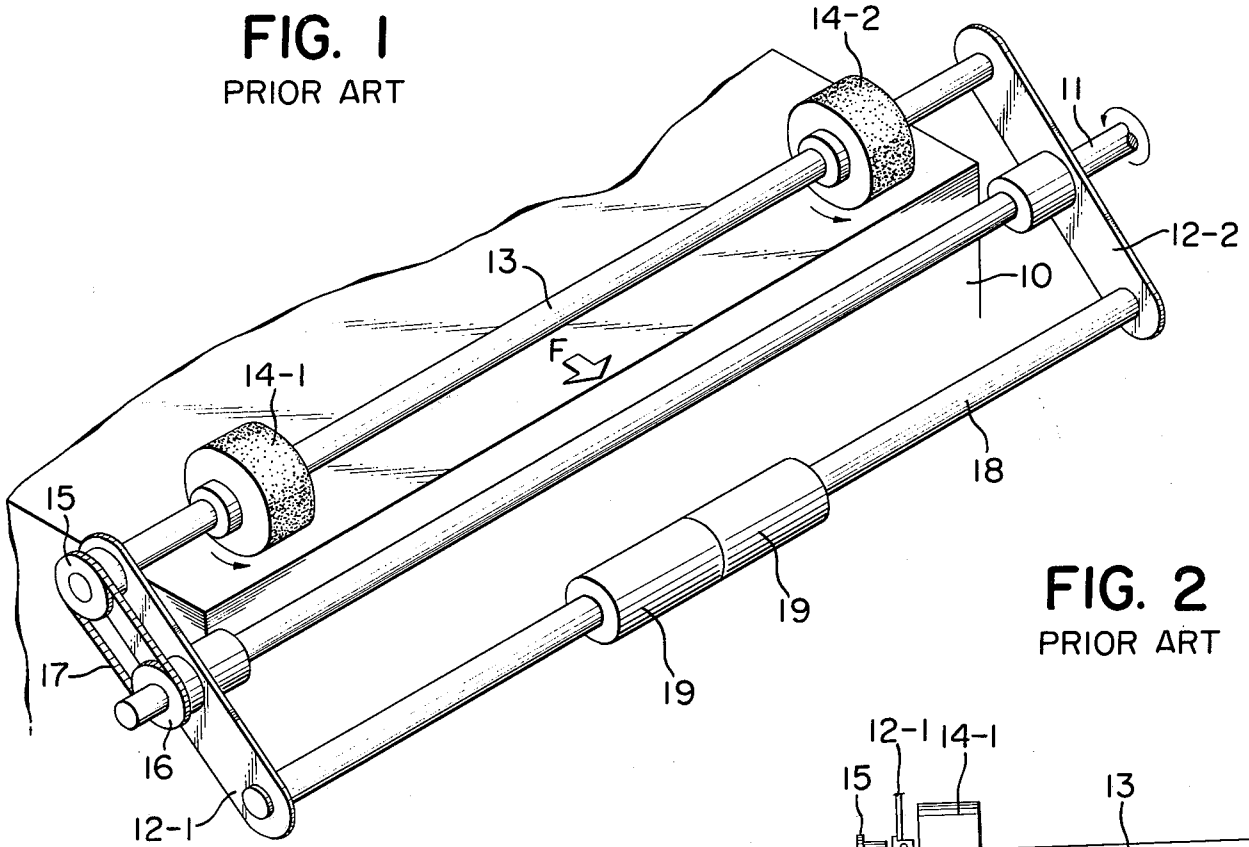
FIG. 1 PRIOR ART
FIG. 1 is a schematic perspective view of a conventional sheet transfer device.
Figure 2:
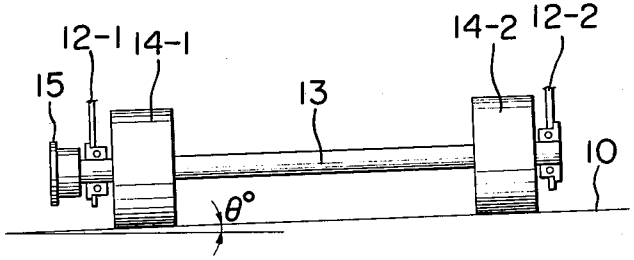
FIG. 2 PRIOR ART
FIG. 2 is an elevation view of the device shown in FIG. 1 in a state wherein the stacked sheets are inclined.

In this second embodiment the rollers 40-1, 40-2 are maintained in uniform contact with the sheet 20 in the above-mentioned manner, and the absence of the coupler 33 shown in FIG. 1 allows the central axis L1-L1 of the roller shaft 32-1 and L2-L2 of the other roller shaft 32-2 to lie approximately parallel to the drive shaft 21.

Thus, strictly speaking, if the rollers 40 are provided with cylindrical peripheral surfaces, the roller 40-1 in such state will be in contact with the sheet 20 at an edge 42-2 rather than at the other edge 42-1, and the roller 40-2 will be in contact likewise with the sheet 20 at an edge 43-2 rather than at the other edge 43-1. There will therefore be a difference, in a strict sense, between the contacting state of the rollers 40-1 and 40-2, but such difference does not give rise to any practically unacceptable diagonal transfer since said rollers are separately driven in the same manner.

The present invention has been explained with respect to an application thereof in a storage device accommodating a large quantity of sheets, but it will be understood that the present invention is also applicable to a storage device accommodating approximately 200 sheets in a cassette as commonly employed in the electronic copying machines.

What I claim:

1. A sheet transfer device comprising:
first arm means rotatably mounted on a position on a drive shaft;
second arm means rotatably mounted on a different position on said drive shaft;
a first supporting shaft rotatably mounted on said first arm means;
a second supporting shaft rotatably mounted on said second arm means;
first connecting means for connecting said first and second supporting shafts in a mutually rotatable manner;
a first sheet transfer roller mounted on said first supporting shaft through a one-directional clutch;
a second sheet transfer roller mounted on said second supporting shaft through a one-directional clutch;
a first transmitting means for transmitting the rotation of said drive shaft to said first supporting shaft;
a second transmitting means for transmitting the rotation of said drive shaft to said second supporting shaft; and
a second connecting means provided between said first and second arm means at the ends thereof opposite to said first and second supporting shafts with respect to said drive shaft; wherein said second connecting means is so structured that one side of said arm means provided with said supporting shafts is heavier around said drive shaft than the other side thereof provided with said second connecting means.

2. A sheet transfer device according to the claim 1 wherein said first connecting means comprises a rotary shaft rotatably mounted on said first supporting shaft, and a stationary shaft fixed on said second supporting shaft and on said rotary shaft.

3. A sheet transfer device according to the claim 1 wherein said first transmitting means comprises a first sprocket affixed on said first supporting shaft, a second sprocket affixed on said drive shaft, and a chain provided over said first and second sprockets.

4. A sheet transfer device comprising:
first arm means rotatably mounted at a position;
second arm means rotatably mounted at a different position;
a first supporting shaft rotatably mounted on said first arm means;
a second supporting shaft rotatably mounted on said second arm means;
connecting means for connecting said first and second supporting shafts in mutually rotatable and axially aligned relationship;
a first sheet transfer roller rotatably mounted on said first supporting shaft;
a second sheet transfer roller rotatably mounted on said second supporting shaft;
first driving means for rotationally driving said first supporting shaft; and
second driving means for rotationally driving said second supporting shaft.

5. A device according to claim 4, wherein said connecting means includes a male coupler fixed on said first supporting shaft and a female coupler fixed on said second supporting shaft.

6. A device according to claim 4, further comprising a second connecting means for connecting said first and second arm means.

7. A device according to claim 6, wherein said second connecting means includes a weight.

8. A device according to claim 4, wherein said first and second sheet transfer rollers are connected with said first and second supporting shafts, respectively, through one-way clutches.

9. A sheet transfer device comprising:
a driving shaft;
first arm means rotatably mounted at a position on said drive shaft;
second arm means rotatably mounted at a different position on said drive shaft;
a first supporting shaft rotatably mounted on said first arm means;
a second supporting shaft rotatably mounted on said second arm means;
connecting means for connecting said first and second supporting shafts in mutually rotatable and axially asigned relationship;
a first sheet transfer roller rotatably mounted on said first supporting shaft;
a second sheet transfer roller rotatably mounted on said second supporting shaft;
a first transmitting means for transmitting the rotation of said drive shaft to said first supporting shaft; and
a second transmitting means for transmitting the rotation of said drive shaft to said second supporting shaft.

10. A device according to claim 9, wherein said first transmitting means includes a first sprocket fixed on said driving shaft, a second sprocket fixed on said first supporting shaft and a chain trained around said first and second sprockets.

11. A device according to claim 9, further comprising second connecting means for connecting said first and second arm means.

12. A device according to claim 9, wherein said connecting means includes a male coupler fixed on said first supporting shaft and a female coupler fixed on said second supporting shaft.

* * * * *